United States Patent [19]

Brubaker

[11] Patent Number: 4,517,543

[45] Date of Patent: May 14, 1985

[54] SME OVERCURRENT PROTECTIVE APPARATUS HAVING AMBIENT TEMPERATURE COMPENSATION

[75] Inventor: John R. Brubaker, Milwaukee, Wis.

[73] Assignee: Eaton Corporation, Cleveland, Ohio

[21] Appl. No.: 557,721

[22] Filed: Dec. 1, 1983

[51] Int. Cl.[3] ..... H01H 61/08; H01H 71/14

[52] U.S. Cl. ..... 337/140

[58] Field of Search ..... 337/140, 395; 60/527

[56] References Cited

U.S. PATENT DOCUMENTS

| | | | |
|---|---|---|---|
| 3,634,803 | 1/1972 | Willson et al. | 337/123 |
| 3,849,756 | 11/1974 | Hickling | 337/140 |
| 3,858,141 | 12/1974 | Lackey | 337/140 |
| 3,967,227 | 6/1976 | Clarke et al. | 337/124 |

*Primary Examiner*—Harold Broome

*Attorney, Agent, or Firm*—C. H. Grace; L. G. Vande Zande

[57] ABSTRACT

A shape memory effect (SME) spring (20) is thermally responsive to currents sensed in itself or in a heater element (66) to pivot an actuator (16) against a bias spring (22) to operate a switch (32) in response to sensed currents above a given level. The actuator (16), bias spring (22) and SME spring (20) are carried by a pivotally mounted support beam (12) which is driven by an ambient temperature compensation mechanism (40,52) to change the amount of switch actuating travel of the actuator (16) in response to ambient temperature changes. The ambient temperature compensation mechanism comprises a pivotal lever (42,54) translationally coupled (**42*a*,54*a*, 12*b*) to the support beam (12). In a first embodiment the lever (42,54) is driven by a temperature sensitive bimetal (46), and in a second embodiment it is driven by a temperature sensitive SME spring (58) biased to a reference position by an adjustable (62) spring (60**).

31 Claims, 3 Drawing Figures

SME OVERCURRENT PROTECTIVE APPARATUS HAVING AMBIENT TEMPERATURE COMPENSATION

BACKGROUND OF THE INVENTION

The invention disclosed herein pertains to current sensitive switch apparatus and more particularly to overcurrent protective switch apparatus. Still more particularly this invention relates to overload relays and the like which are thermally responsive to increased current levels to interrupt power to a protected device. The invention is particularly adapted for use in protecting electric motors and other load devices against overload currents.

Conventional overload relays utilize current sensing heater coils to actuate spring-loaded latch trip contact actuator mechanisms. Such mechanisms are large and comprise many parts, are difficult and time consuming to assemble and calibrate, and in many embodiments actuate the contacts near the end of travel of the springs when the forces have weakened and are less predictable.

Shape memory effect (SME) alloys may be advantageously employed in overcurrent protective switch apparatus to provide simpler but more efficient switch mechanisms than the aforedescribed types. Elements made of SME alloys are formed to a first configuration, heated and subsequently cooled while restrained in that configuration, and thereafter reformed to a second configuration. The material possesses a transition temperature level and upon being heated to that level, the element reverts back to the first configuration, releasing significant forces in that transformation. By suitably shaping and biasing the element it can be made to return to the second configuration upon cooling below the transition temperature. Biasing the element also permits the temperature range at which the physical transformation occurs to be more precisely controlled. By utilizing SME elements in overcurrent responsive switches of the aforedescribed type, larger and more predictable switch operating forces can be obtained which enables less refined switching contact structures to be employed without concern for trip point variations caused when contact forces offset operating mechanism forces. The SME elements also provide larger amounts of displacement for given temperature increases than are provided by the commonly used bimetal elements, thereby reducing the manufacturing tolerances for the switch apparatus. The SME element is electrically conductive, and thus it may be utilized to directly sense the current level being received by the load device, being heated by current flowing through it to therefor also serve as the heater unit. Thus a single SME element can perform the functions of several distinct elements of a conventional overload relay, and operates in a more positive, improved manner.

SUMMARY OF THE INVENTION

To provide complete overload protection for electric motors and the like, overload relays and similar devices are provided with ambient temperature compensation means which varies the current levels at which the protective device switches in accordance with the ambient temperature.

This invention therefor provides SME operated overcurrent protective apparatus having ambient temperature compensating means. More specifically the invention provides electric overcurrent protective apparatus having a switch, an actuator system which has a current sensing shape memory effect element thermally responsive to sensed current and temperature responsive for effecting switch actuating movement of the actuator, and temperature sensitive means thermally responsive to ambient temperature for changing the amount of actuator movement required for switch actuation.

DESCRIPTION OF THE PREFERRED EMBODIMENT

Figure 1:
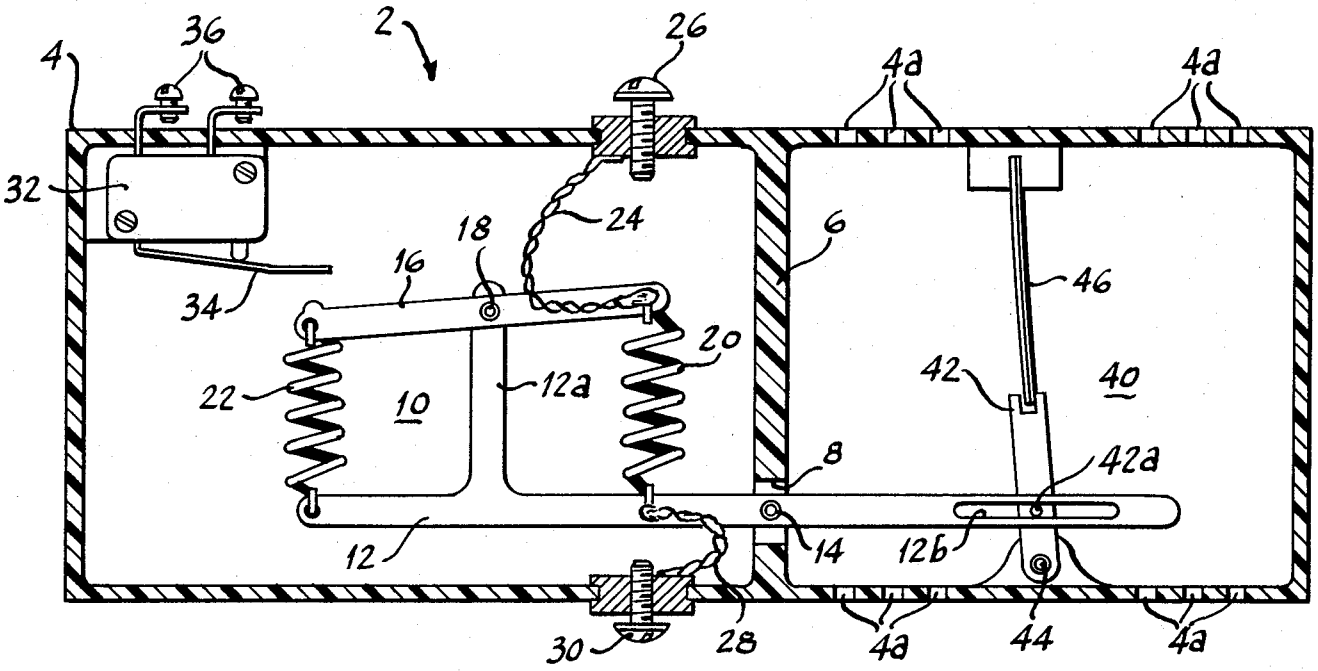
FIG. 1 is a cross-sectional view of a first embodiment of an electric overload relay constructed in accordance with this invention.

Referring to FIG. 1, an overload relay 2 comprises an insulating housing 4 divided into two compartments by an intermediate wall 6. The housing may have a removable cover (not shown) to fully enclose the switch apparatus therein. Wall 6 has an opening 8 communicating between the two compartments of the housing.

A switch actuating mechanism 10 has a support beam 12 extending through opening 8 into each of the compartments of housing 4. Support beam 12 is pivoted within the opening 8 by a pin 14. The left-hand end of beam 12 has an upstanding post **12*a* to which an actuator 16 is pivotally affixed by a pin 18. A thermally-actuated spring 20 made from a shape memory effect (SME) alloy is connected in tension between the right-hand end of actuator 16 and support beam 12. A helical tension spring 22 is connected between the left-hand end of actuator 16 and support beam 12 to oppose SME spring 20 and bias the actuator to a balanced position between the two springs 20 and 22**.

A flexible braid electric conductor 24 is connected to the upper end of spring 20 by soldering or the like at the point where the spring hooks into an opening in actuator 16. At its other end braid 24 is connected to a screw terminal 26 mounted on the housing 4. The lower end of spring 20 is similarly connected to a flexible braid connector 28 which in turn is connected to a screw terminal 30 mounted on housing 4.

A switch device 32 is mounted to housing 4 near the left-hand end of actuator bar 16 to position an operator 34 for the swtich device in the path of movement of actuator 16. Terminals 36 project exteriorly of housing 4 and connect the contacts of switch device 32 in a control circuit for an electric motor or other load device to be protected by overload relay 2. Current sensing SME spring 20 is directly connected in the load device circuit by connecting terminals 26 and 30 so that current flowing to the load device also flows through SME spring 20, generating heat to raise the temperature of spring 20 in proportion to the current flowing through it. Increased current flow creates higher temperature in the spring, and the SME material of spring 20 responds to increased temperature by contracting its length. As the transition temperature of SME spring is passed, the force supplied by spring 22 is overcome and the spring 20 rapidly contracts to pivot actuator 16 clockwise about pivot 18, causing the lefthand end of the bar to engage operator 34 and operate the switch 32 to effect interruption of power to the load device. Current flow is thereby interrupted in SME spring 20, permitting that spring to cool from its raised temperature. Bias spring 22 acting on actuator 16 stretches spring 20 to its original length, thereby pivoting actuator 16 counter-clockwise to release the operator 34 of switch 32 and reset the overload relay.

An objective in protecting electric motors is to cause them to run as cool as possible at rated current and load. Current flow in the windings raises the winding temperature. The current flow in the windings is sensed to cause the overload relay actuating mechanism to operate the relay switch contacts to disconnect the motor, either directly or through an intermediate contactor, when the current flow is of a magnitude where damage to the motor would occur if it were permitted to continue running. Ambient temperature also raises the temperature of the motor windings and it will be appreciated that if an overload relay operated solely at a fixed current level without regard to ambient conditions, the winding temperature could be elevated above a potentially damaging temperature by a combination of ambient and overcurrent conditions before the relay operates.

Overload relay 2 is provided with an ambient temperature compensation mechanism 40 in the right-hand compartment of housing 4. This mechanism comprises a lever 42 pivotally mounted to housing 4 by pin 44, and a thermally responsive bimetal 46 fixed at one end to housing 4 and operatively coupled at its free end with the free end of lever 44. Housing 4 has a plurality of openings **4*a* in the exterior walls of the right-hand compartment to enable ambient heat to circulate within that compartment. Bimetal 46 is arranged to deflect to the left, or clockwise, about its fixed end as the ambient temperature increases. This movement pivots lever 42 counter-clockwise. A drive pin 42*a* carried by lever 42 is received within a slot 12*b* in support beam 12. As lever 42 is pivoted counter-clockwise, pin 42*a* drives the right-hand end of support beam 12 to pivot the support beam clockwise about pin 14. This movement carries the left-hand end of actuator 16 closer to switch operator 34, thereby requiring less movement by actuator 16 relative to support beam 12 to trip the switch 32. Accordingly, spring 20 will provide adequate switch operating movement to the actuator 16 when sensing a lesser amount of current in the motor circuit. As the bimetal cools in response to decreases in ambient temperature the system reverses in direction and the gap between the left-hand end of the actuator 16 and operator 34** is increased.

Figure 2:
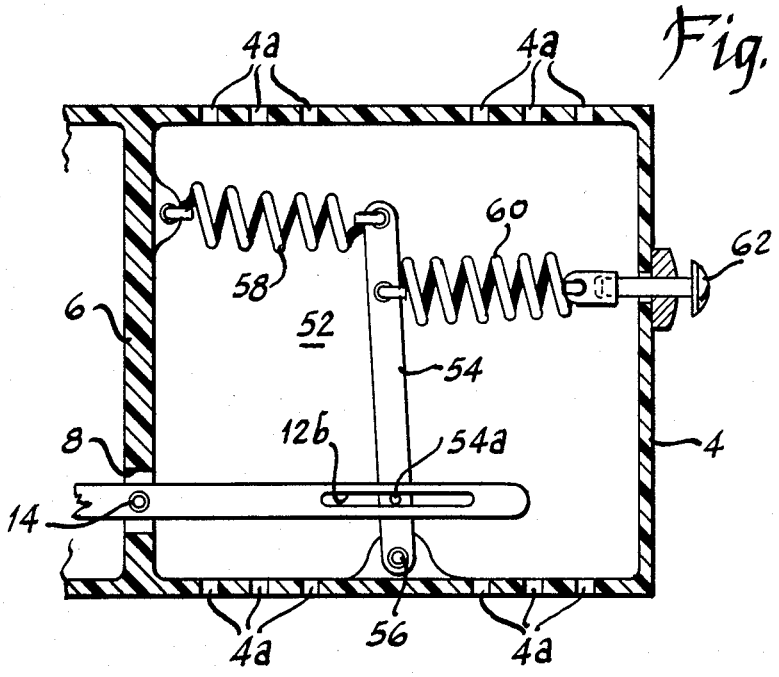
FIG. 2 is a partial cross-sectional view of a second embodiment of an electric overload relay constructed in accordance with this invention.

A second embodiment of this invention is shown in FIG. 2 wherein the right-hand compartment of housing 4 is shown. Like parts common to the embodiment of FIG. 1 have been given like reference numerals. An ambient temperature compensation mechanism 52 is provided in FIG. 2 which comprises a lever 54 pivotally mounted to housing 4 by pin 56, a thermally responsive SME coil spring 58 connected in tension between intermediate wall 6 of housing 4 and the free end of lever 54, and a bias spring 60 connected in tension between lever 54 and an adjustment screw 62 on housing 4 in opposition to SME spring 58. Screw 62 moves axially inwardly or outwardly of housing 4 according to the direction of rotation thereof to decrease or increase, respectively, the bias applied to SME spring 58 and thereby to determine a reference position indicative of a reference ambient temperature for the compensation mechanism 52. A drive pin **54*a* carried by lever 54 is received within slot 12*b* in support beam 12**.

SME spring 58 senses the ambient temperature and contacts in response to temperature increases above the reference temperature. As the force applied to lever 54 by SME spring 58 overcomes the force of spring 60, lever 54 is rotated counter-clockwise to drive the support beam 12 of actuator mechanism 10 clockwise about pivot pin 14, thereby to reduce the gap between the left-hand end of actuator 16 and switch operator 34. As described in conjunction with relay 2, the switch 32 is accordingly operated in response to lower levels of sensed current by SME spring 20. As the ambient temperatures cool, bias spring 60 acts through lever 54 to stretch SME spring 58 and return the system to its original condition.

Figure 3:
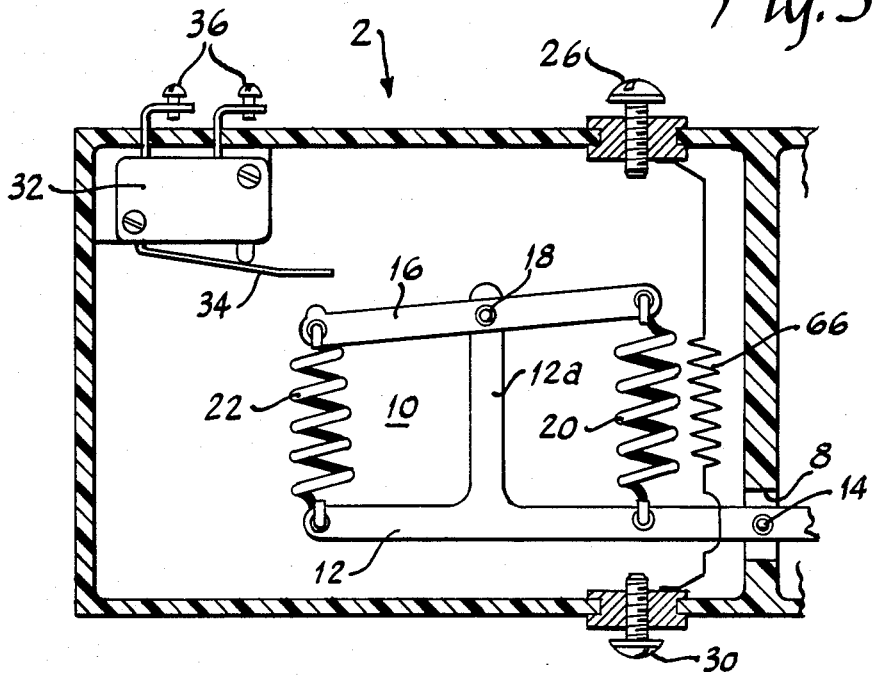
FIG. 3 is a partial cross-sectional view of another embodiment of an electric overload relay constructed in accordance with this invention.

FIG. 3 discloses another embodiment of this invention. Shown therein is the left-hand compartment of housing 4. Most of the parts of the mechanism contained in this compartment are the same as those shown and described in conjunction with FIG. 1, and have been given the same reference numerals. However, in the embodiment of FIG. 3, a separate current sensing element 66 has been provided between terminals 26 and 30 to extend in proximity to SME spring 20. Pigtail connectors 24 and 28 have been omitted. In this embodiment the SME spring 20 does not directly sense the current flowing to the motor, but is thermally responsive to that current by sensing the related heat from element 66.

The foregoing has described several exemplary embodiments of SME operated overcurrent protective apparatus having ambient temperature compensation means for adjusting the current levels at which the apparatus contacts are operated as a function of ambient temperature conditions. It is to be understood that the invention herein disclosed is susceptible of various modifications without departing from the scope of the appended claims.

I claim:

1. Electric overcurrent protective apparatus comprising, in combination:

switch means comprising switch contacts connectable in a circuit for controlling power supplied to protected apparatus and a switch operator movable for effecting operation of said contacts for disconnecting power to said protected apparatus;

actuating means adjustably positioned relative to said switch operator and engagable with said switch operator upon movement of said actuating means for effecting contact operating movement of said switch operator, said actuating means comprising current sensing shape memory effect (SME) means connectable in circuit with said protected apparatus, said SME means being thermally responsive to current flow in said protected apparatus and temperature responsive for effecting said movement of said actuating means; and temperature sensitive means thermally responsive to ambient temperature for adjusting the position of said actuating means relative to said switch operator for changing the amount of said actuating means movement required for effecting contact operating movement of said switch operator.

2. The invention defined in claim 1 wherein said actuating means comprises bias means for resisting said actuating means movement effected by said SME means and for overcoming said SME means in response to decreases in said current flow for restoring said SME means toward an initial condition and for resetting said actuating means.

3. The invention defined in claim 2 wherein said ambient temperature sensitive means comprises means operably connected to said actuating means displaceable from an initial position for adjusting the position of said actuating means in one direction in response to ambient temperatures above a reference temperature and restorable toward said initial position for adjusting the position of said actuating means in an opposite direction when said ambient temperatures decrease toward said reference temperature.

4. The invention defined in claim 3 wherein said ambient temperature sensitive means comprises adjustment means for establishing said initial position of said displacable means.

5. The invention defined in claim 3 wherein said ambient temperature sensitive means comprises second SME means connected to said displacable means and operable for effecting displacement for adjusting said position in said one direction and second bias means connected to said displacable means disposed in opposition to said second SME means for overcoming said SME means when said ambient temperature decreases toward said reference temperature for restoring said displacable means toward said initial position.

6. The invention defined in claim 5 wherein said ambient temperature sensitive means comprises adjustment means coupled to said second bias means for determining said initial position.

7. The invention defined in claim 2 wherein said actuating means is mounted for pivotal movement relative to said switch means.

8. The invention defined in claim 2 wherein said actuating means comprises an actuator operated by said SME means for effecting said contact operator movement of said switch means.

9. The invention defined in claim 8 wherein said actuating means comprises a support member, pivotally mounted relative to said switch means and carrying said actuator thereon.

10. The invention defined in claim 9 wherein said SME means and said bias means are carried by said support member.

11. The invention defined in claim 10 wherein said actuator is pivotally mounted on said support member.

12. The invention defined in claim 9 wherein said ambient temperature sensitive means comprises second SME means operable to effect pivotal movement of said support member.

13. The invention defined in claim 12 wherein said ambient temperature sensitive means comprises second bias means opposing said pivotal movement effected by said second SME means.

14. The invention defined in claim 8 wherein said ambient temperature sensitive means comprises a pivoted lever coupled to said actuating means for adjusting the position of said actuator relative to said switch means in response to changes in ambient temperature.

15. The invention defined in claim 14 wherein said ambient temperature sensitive means comprises thermally responsive bimetal means operable to effect displacement of said lever.

16. The invention defined in claim 14 wherein said ambient temperature sensitive means comprises second SME means operable on said lever for effecting displacement of said lever.

17. The invention defined in claim 14 wherein said actuating means is pivotally movable for adjusting the position of said actuator relative to said switch means.

18. An electric overload relay comprising, in combination:

switch means comprising switch contacts connectable in a circuit for controlling power supplied to protected apparatus and a switch operator movable for effecting operation of said contacts for disconnecting power to said protected apparatus;

a support movable relative to said switch means;

an actuator carried by said support;

thermally reactive current sensing means connectable in circuit with said protected apparatus;

shape memory effect (SME) means carried by said support and operable upon said actuator, said SME means being thermally responsive to said current sensing means for effecting movement of said actuator into engagement with said switch operator for effecting of said switch contacts; and temperature sensitive means thermally responsive to ambient temperature for moving said support to change the position of said actuator relative to said switch operator for changing the amount of actuator movement required for effecting contact operating movement of said switch operator.

19. The invention defined in claim 18 wherein said ambient temperature sensitive means comprises means operably connected to said support displaceable from an initial position for adjusting the position of said support in one direction in response to ambient temperatures above a reference temperature and restorable toward said initial position for adjusting the position of said support in an opposite direction when said ambient temperatures decrease toward said reference temperature.

20. The invention defined in claim 19 wherein said ambient temperature sensitive means comprises adjustment means for establishing said initial position of said displacable means.

21. The invention defined in claim 18 wherein said temperature sensitive means comprises second SME means connected to said displacable means for defining a first position establishing a reference ambient temperature and said SME means being operable in response to increased temperature to move said displacable means from said first position, thereby to move said support for adjusting the position of said actuator relative to said switch operator.

22. The invention defined in claim 21 further comprising adjustable biasing means connected to said displacable means for opposing movement thereof by said SME means for adjustably varying said reference ambient temperature.

23. The invention defined in claim 18 further comprising a lever pivoted by said second SME means and means coupling said lever to said support.

24. The invention defined in claim 18 further comprising bias means for opposing movement of said actuator means by said SME.

25. The invention defined in claim 24 wherein said SME means and said bias are operatively disposed between said support and said actuator means.

26. The invention defined in claim 25 wherein said actuator is pivotally mounted on said support.

27. The invention defined in claim 26 wherein said temperature sensitive means comprises second SME means biased to a reference position.

28. The invention defined in claim 27 further comprising adjusting means for varying the bias on said second SME means for varying said reference position.

29. The invention defined in claim 28 further comprising a pivoted lever driven by said second SME means and operatively coupled to said support.

30. The invention defined in claim 29 wherein said support is mounted for pivotal movement relative to said switch means.

31. The invention defined in claim 28 wherein said lever and support are operatively joined by a translational coupling.

* * * * *